United States Patent [19]

DiRubbio et al.

[11] Patent Number: 4,926,752

[45] Date of Patent: May 22, 1990

[54] SAFETY FUZE FOR A HAND GRENADE

[76] Inventors: Vincent DiRubbio, 580 E. Ash St., Perry, Fla. 32347; Edmund V. Galinski, P.O. Box 860, Andover, N.J. 07821

[21] Appl. No.: 319,694

[22] Filed: Mar. 7, 1989

[51] Int. Cl.[5] ..... F42B 27/08

[52] U.S. Cl. ..... 102/486; 102/202.13; 102/487

[58] Field of Search ..... 102/202.13, 204, 482, 102/486, 487, 488

[56] References Cited

U.S. PATENT DOCUMENTS

| | | | |
|---|---|---|---|
| 2,042,461 | 6/1936 | Gibson et al. . | |
| 2,421,762 | 6/1947 | Short . | |
| 2,562,928 | 7/1951 | Lewis . | |
| 2,911,913 | 11/1959 | Sunden . | |
| 3,603,257 | 9/1971 | White et al. . | |
| 3,731,631 | 5/1972 | Berlin et al. . | |
| 4,369,708 | 1/1983 | Bryan et al. | 102/202.13 |
| 4,383,470 | 5/1983 | Assmann . | |
| 4,513,667 | 4/1985 | Caruso . | |
| 4,699,063 | 10/1987 | Aschwanden et al. | 102/482 |

FOREIGN PATENT DOCUMENTS

| | | | |
|---|---|---|---|
| 1147516 | 4/1963 | Fed. Rep. of Germany | 102/482 |
| 2500619 | 8/1982 | France | 102/487 |
| 2059553 | 4/1981 | United Kingdom . | |

OTHER PUBLICATIONS

"Hand Grenade Fuze M213 Assembly," U.S. Army Armanent Research and Development Command, Dover, N.J., (Mar. 2, 1960).

*Primary Examiner*—Harold J. Tudor

*Attorney, Agent, or Firm*—Mason, Fenwick & Lawrence

[57] ABSTRACT

A safety fuze for a hand grenade comprises a fuze body, a delay case assembly, a detonator assembly, an initiator lever assembly, a cover assembly, and a pull ring assembly. The fuze body has a head, a stem, and a central portion, and a bore extending longitudinally therethrough. The delay case assembly comprises a delay case matingly received in the bore and having an upper primer portion containing a primer, a lower delay portion containing ignition, delay and penetration charges, a sealant separating the primer portion from the delay portion, and an air gap separating the primer portion from the ignition charge. The detonator assembly comprises a detonator case matingly receiving the fuze body stem at the top thereof and being in sealing engagement with the fuze body, and has an explosive detonator charge at the bottom thereof. A gap is provided between the fuze body bottom and the explosive charge. The initiator lever assembly comprises an elongated initiator lever rotatably mounted at its proximal end to the fuze body head and biased in its primed position. A firing pin formed integrally with the initiator lever is positioned to engage the primer when the initiator lever assembly is in its primed position. The cover assembly covers the top and back of the fuze body head. Either the initiator lever or the cover assembly can be elongated to define a handle for holding and throwing the grenade. A rotatable safety latch can be mounted on the cover assembly.

34 Claims, 6 Drawing Sheets

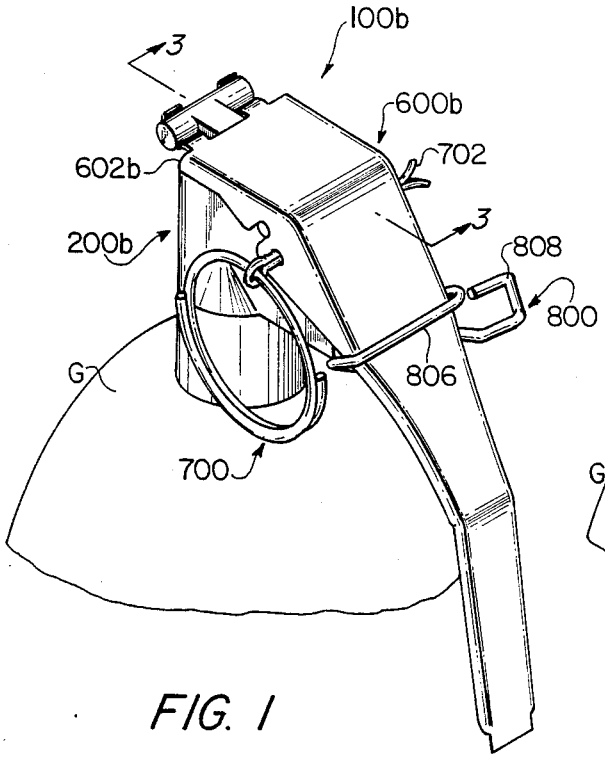
FIG. 1
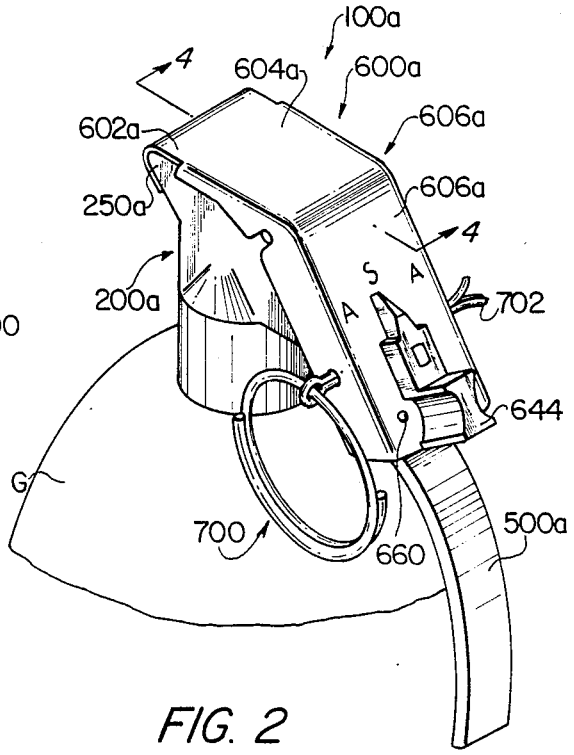
FIG. 2
FIG. 3
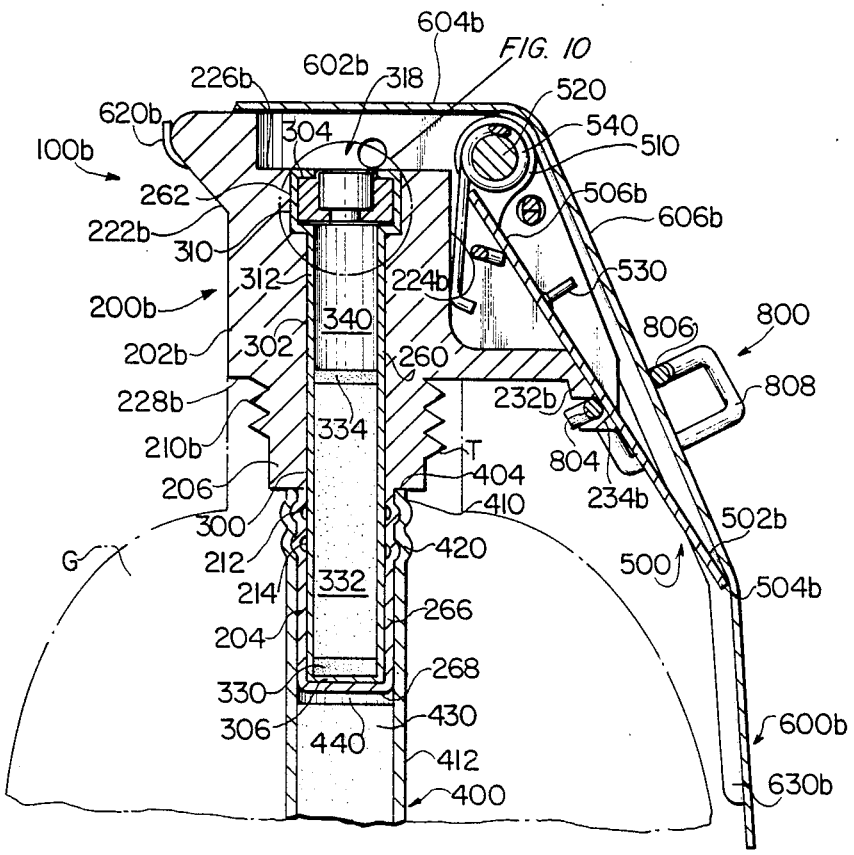

SAFETY FUZE FOR A HAND GRENADE

BACKGROUND OF THE INVENTION

The present is directed to the field of grenades, and more specifically to a safety fuze for use with hand grenades.

The hand grenade presently in use by the U.S. Department of Defense is the M213, shown in FIG. 11 and U.S. Pat. No. 2,562,928 to Lewis. The hand grenade fuze 100′ incorporates a number of features standard in hand grenades and similar, hand thrown, fuze-activated devices. For example, a pull ring assembly 700′ is inserted through the lever 600′, through apertures in the fuze body 100′, over the striker assembly 500′ to restrain the striker assembly 500′ in the safe position. Also, a safety clip 800′ is fastened around the lever 600′ and an extension 232′ of the fuze body 200′ to prevent accidental, premature release of the lever 600′ and the striker assembly 500′ if the pull ring assembly 700′ was accidentally removed.

However, in military situations when silence is of the utmost importance, the user frequently employs the unauthorized, unsafe, procedure of removing the safety clip 800′ to avoid detection by the enemy given by the distinctive sound from its removal, or the noise it produces upon impacting objects after being discarded. Also, because of the short length of the striker assembly 500′, if the lever 600′ is unknowingly released even a slight amount after the pull ring assembly 700′ is removed, the striker assembly 500′ will be allowed to rotate and the striker 530′ will hit the primer 320′, initiating the firing sequence. As this can occur without the knowledge of the user, the grenade can function while still in the user's hand or attached to an article of clothing.

Most fuze assemblies for hand grenades and the like employ lever and striker assemblies similar to those of the M213. Examples of such assemblies are disclosed in U.S. Pat. No. 2,042,461 to Gibson et al.; U.S. Pat. No. 2,421,672 to Short; U.S. Pat. No. 2,911,913 to Suden; and U.S. Pat. No. 4,513,667 to Caruso.

Another safety problem encountered with the M213 is associated with the firing train assembly, i.e., the primer assembly, the delay charge/cavity, and the detonator assembly. In the M213, the detonator charge is in direct fluid communication with the delay charge/cavity in the fuze body stem, and the delay charge/cavity is in direct fluid communication with the primer assembly. An insufficient amount of delay charge can cause a grenade to function, after the firing train has been initiated, in a shorter time than that required of complete delay charge. Also, the absence of any delay charge in the delay cavity can cause an instantaneous functioning of the grenade after the firing train has been initiated. Also, a crack or cracks, or porosity having fluid communication between the interior stem cavity and the outer stem wall of the fuze body, can permit hot gasses to be in like fluid communication with the interior of the detonator assembly. Also, the through fluid communication within the components of the firing train can cause deterioration of the explosive or pyrotechnic components, shortening shelf life and endangering the user who is depending on reliable performance of the device.

Other fuzes for hand grenades employ primer, delay, and detonator assemblies similar to those of the M213, as shown by U.S. Pat. No. 4,383,470 to Assman.

It is the solution of these and other problems to which the present invention is directed.

SUMMARY OF THE INVENTION

Therefore, it is the primary object of this invention to provide a safety fuze for a hand grenade in which the initiator lever assembly o striker cannot be unknowingly released.

It is still another object of this invention to provide the user with safety against instantaneously fired hand grenades.

It is also another object of this invention to provide the user with safety against critically early detonation of the hand grenades.

It is still another object of this invention to prevent premature detonation of the grenade from hot gasses entering the detonator assembly through cracks or porosity.

It is still another object of this invention to ensure adequate ignition of the pyrotechnic charges.

It is still another object of this invention to provide a safety fuze for a hand grenade that will prevent the internal migration of moisture, vapors, and other foreign matter, and entry or escape of same from or to the atmosphere.

These and other objects of the invention are achieved by the provision of a safety fuze for a hand grenade comprising a fuze body, a delay case assembly, a primer assembly, a detonator assembly, an initiator lever assembly, a cover assembly, and a pull ring assembly. The fuze body has a head, a stem, and a central portion intermediate the fuze body head and stem, and a bore extending longitudinally therethrough. The delay case assembly comprises a delay case matingly received in the bore and having a primer portion adjacent the top and a delay portion adjacent the bottom, and a sealant separating the primer portion from the delay portion. A primer holder, a primer and a primer booster charge comprising the primer assembly are positioned in the primer portion. A penetration charge is positioned at the bottom of the delay case, a delay charge is positioned above the penetration charge, and an ignition charge is positioned above the delay charge. An air gap separates the primer assembly from the ignition charge.

The detonator assembly comprises a detonator case matingly receiving the fuze body stem at the top thereof and being in sealing engagement with raised crimp surfaces on the fuze body, and having an explosive detonator charge positioned at the bottom thereof. A gap is provided between the fuze body stem bottom and the explosive charge.

The initiator lever assembly is mounted on the fuze body and is rotatable between an unprimed position and a primed position. It comprises an elongated initiator lever, mounting means for mounting the proximal end of the initiator lever to the fuze body head adjacent the fuze body top for rotation about an axis perpendicular to the plane of symmetry of the initiator lever; biasing means for biasing the initiator lever in its primed position, and a firing pin formed integrally with the initiator lever, the firing pin being positioned on the initiator lever to engage the primer when the initiator lever assembly is in its primed position. The initiator lever has such a length that in its primed position, its distal end extends forwardly of the front wall of the fuze body head.

The cover assembly covers the top and back of the fuze body head and includes a pair of opposed pin-receiving apertures in registration with apertures in the side walls of the fuze body head.

The pull ring assembly has an elongated retaining pin adapted to be inserted through the apertures in the cover assembly and the side walls of the fuze body head. The retaining pin retains the initiator lever in its unprimed position when inserted through the apertures.

In one aspect of the invention, the initiator lever is longer than and extends below the cover assembly and defines a handle to be restrained while holding and throwing the grenade.

In another aspect of the invention, the cover assembly is longer than and extends below the striker assembly and defines a handle to be restrained while holding and throwing the grenade.

In still another aspect of the invention, a safety latch is mounted on the cover assembly. The safety latch is movable between a first position for retaining the initiator lever in its unprimed position by engaging the apertures in the side walls of the fuze body head and a second position for permitting movement of the initiator lever into its primed position.

A better understanding of the disclosed embodiments of the invention will be achieved when the accompanying detailed description is considered in conjunction with the appended drawings, in which like reference numerals are used for the same parts as illustrated in the different figures.

BRIEF DESCRIPTION OF THE DRAWINGS

FIG. 1 is a perspective view of a first embodiment of the safety fuze of the invention;

FIG. 2 is a perspective view of a second embodiment of the safety fuze of the invention;

FIG. 3 is a cross-sectional view of the safety fuze of FIG. 1, taken along line 3—3 of FIG. 1;

DESCRIPTION OF THE PREFERRED EMBODIMENTS

Figure 4:
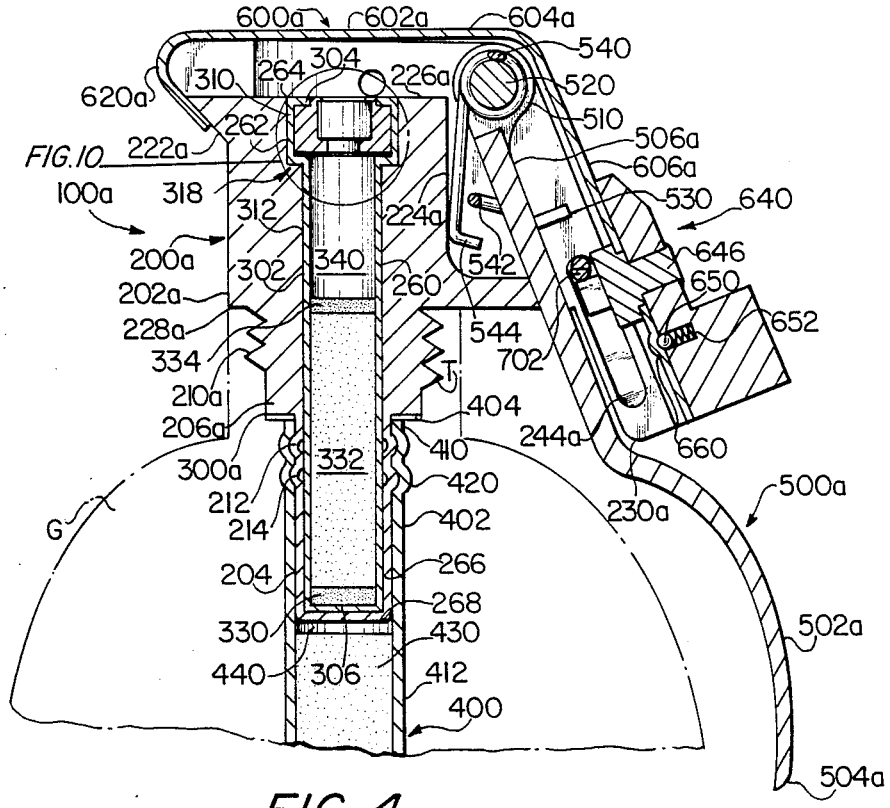
FIG. 4 is a cross-sectional view of the safety fuze of FIG. 2, taken along line 4—4 of FIG. 2.
Figure 5A:
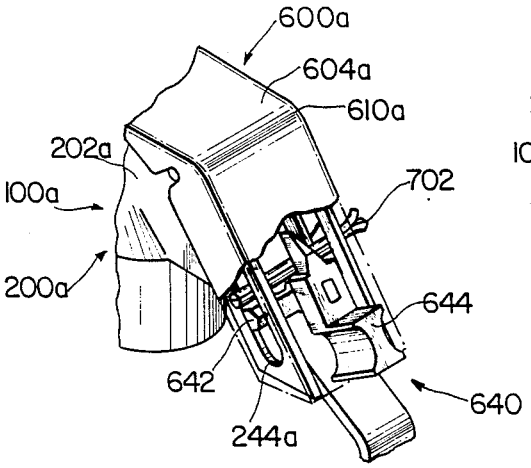
FIG. 5*a* is a partial perspective view with parts broken away, showing the safety latch of the safety fuze of FIG. 2 in its first, locked position.
Figure 5B:
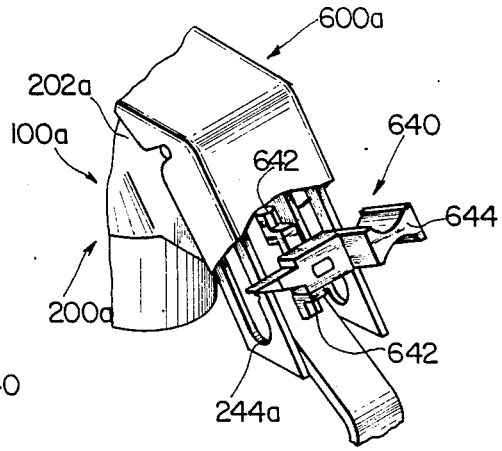
FIG. 5*b* is a partial perspective view with parts broken away, showing the safety latch of the safety fuze of FIG. 2 in its second, unlocked position.

Referring now to FIGS. 2, 4, 5*a*, 5*b*, 7, and 10, there is shown a first embodiment of a safety fuze 100*a* for a hand grenade G. Fuze 100*a* comprises a fuze body 200*a* having a head 202*a*, a stem 204, and a central portion 206 intermediate head 202*a* and stem 204. Central portion 206 includes external threads 210 for engaging mating internal threads T at the top of grenade G.

Stem 204 adjacent central portion 206 is provided with raised upper and lower annular lips 212 and 214, for a purpose to be described hereinafter. Lips 212 and 213 are formed as part of the die cast procedure for fuze body 200*a*. Lower lip 214 has a slightly smaller diameter than upper lip 212.

Body 200*a* can be cast or molded as can bodies 200*b* and 200*c* described hereinafter.

Head 202*a* has a pair of opposed side walls 220*a* of substantially right trapezoidal profile, a front wall 222*a*, a back wall 224*a* opposite front wall 222*a* and inset from the back edges of side walls 220*a*, a top wall 226*a* insert from the top edges of side walls 220*a*, and a bottom wall 228*a* opposite top wall 226*a*. Side walls 220*a* include a pair of opposed, parallel extensions 230*a* extending downwardly from bottom wall 228*a*. Side walls 220*a* also include an upper pair of opposed circular apertures 240*a* adjacent their back, upper corners, and a lower pair of opposed elongated slots 224*a* space downwardly from upper circular apertures 240*a* and extending into the extensions 230*a*, all for a purpose to be described hereinafter. Front wall 222*a* includes a pair of hinge lugs 250*a* extending from the top thereof, also for a purpose to be described hereinafter.

A cylindrical bore 260 extends longitudinal through fuze body 200*a*. Cylindrical bore 260 has a top portion 262 terminating at an opening 264 in top wall 226*a* and a bottom portion 266 terminating at a closure 268 at the bottom of stem 204.

A delay case assembly 300 is matingly received in bore 260 and comprises a delay case 302 having atop 304 and a closed bottom 306, a primer portion 310 adjacent top 304, and a delay portion 312 adjacent bottom 306. Delay portion 312 is recessed inwardly from primer portion 310, primer portion 310 being matingly received in top portion 262 of bore 260, and delay portion 312 being matingly received in bottom portion 266 of bore 260.

Primer portion 310 of delay case assembly 300 houses a primer assembly 318 comprising a primer 320, a primer booster charge 322 positioned below primer 320, and a primer holder 324 rigidly holding primer 320 and primer booster charge 322 in primer portion 310, a penetration charge 330 positioned at bottom 306 of delay case 302, a delay charge 332 positioned immediately above penetration charge 330, and an ignition charge 334 positioned immediately above delay charge 332, and an air gap 340 separating primer assembly 318 from ignition charge 334. Delay case 302 and fuze body stem 204 are both closed at the bottom to prevent the flash from primer 320, when initiated, from penetrating delay case 302 and fuze body 204 and to provide sealed, double-walled protection between the pyrotechnic charges and the detonator case discussed hereinafter.

As primer 320 is a low output primer, for which there may be improper ignition, primer booster charge 322 is provided to enhance the output of primer 320.

Primer holder 324 is crimped to retain primer 320 in place and primer portion 310 is crimped at top 304 of delay case 302 to retain primer holder 324 in primer portion 310. The crimped areas are coated with a moisture-proofing sealant such as phenolformaldehyde varnish, type III, grade A or B, Spec. MIL-V-13750. A sealant 350 such as nitrocellulose is applied to the bottom of primer holder 324 to bond primer booster charge 322 in place and to provide a positive seal between primer portion 310, primer holder 324 and delay portion 312.

Penetration charge 330, delay charge 332, and ignition charge 334 are all mixtures which are gasless or produce low pressure hot gases, so that they can be sealed within delay case 302. Air gap 340 provides expansion space for those gases.

Pyrotechnic formulations such as the following can be used. Ignition charge 334 weighs approximately 100 mg and has a composition by weight of 65 %±5 % zirconium, MIL-Z-399, type 2, class 2; 25 %±3% iron oxide, TT-P-375, type 1 or 2; 10 %±2 % diatomaceous earth having the following characteristics: 0.4 % loss of weight on ignition, 90 % minimum silica, and 99 % minimum granulation passing through a 325 mesh; and 0.5 % maximum binder. Delay charge 332 weighs approximately 1200 mg and has a composition by weight of 49 % tungsten MIL-T-48140, amend. I; 5% potassium perchlorate, MIL-P-217, grade A, class 4; 41 % barium chromate, MIL-B-550, grade A; and 5 % diatomaceous earth having the following characteristics: 0.4 % loss of weight on ignition, 90 % minimum silica, and 99 % minimum granulation passing through a 325 mesh; and 0.5 % maximum binder. Penetration charge 330 weighs approximately 100 mg and has a composition by weight of 75 %±5 % iron oxide, TT-P-375, type 1 or 2; 25 %±5 % magnesium, MIL-M-382, type 1, grade A, granulation 12; 0.5 % maximum binder. The binder can be omitted from ignition charge 334 and penetration charge 330, and the proportions of ingredients in delay charge 332 can be varied in a known manner to obtain the desired burning rate without jeopardizing the safety features herein described.

The charges are assembled in the following manner. Penetration charge 330 is inserted into bottom 306 of delay case 302 with a load of 20,000 to 40,000 lb./sq.in. for a pre-established dwell period of 3.0 sec. ±0.5 sec. Three increments of delay charge 332 are then pressed into delay case 302 directly on top of penetration charge 330 with a load of approximately 40,000 lb./sq.in. for a pre-established dwell period of 3.0 sec. ±0.5 sec. Finally, ignition charge 334 is pressed into delay case 302 directly on top of delay charge 332 with a load of approximately 40,000 lb./sq.in. for a pre-established dwell period of 3.0 sec. ±0.5 sec.

When ignited, penetration charge 330 will burn through bottom 306 of delay case 302 and closure 268 of bore 260.

The above-disclosed mixtures used for penetration, delay, and ignition charges 330, 332, and 334 generate lower hot gas pressures than the zirconium-nickel mixes currently in use in the prior art devices. Such lower hot gas pressures are desirable, in that they produce uniform burning rates and have proven long shelf life characteristics, in contrast to the zirconium-nickel mixes which decay significantly during storage, tending to increase delay times and to produce occasional duds. The higher gas pressures in the prior art devices can result in the gasses being forced through porous or cracked delay cavity walls into the detonator.

Stem 204 of fuze body **200*a* is matingly received in a detonator assembly 400. Detonator assembly 400 comprises a detonator case 402 having an open top 404 and a closed bottom (not shown), a receiving portion 410 adjacent top 404, and a detonator portion 412 adjacent the bottom. Receiving portion 410 matingly receives stem 204 of fuze body 200*a*. Detonator case 402 is crimped around lips 212 and 214 of fuze body stem 204 at 420 in a known manner to positively seal the interior of detonator case 402 against the entry or escape of moisture, vapors or other foreign matter and to provide an interference fit of detonator case 402 with fuze body stem 204. The difference in the diameters of lips 212 and 214 permits detonator case 402 to be stretched over lips 212 and 214**.

The raised crimp surfaces 420 provide a positive sealing engagement between detonator case 402 and fuze body stem 204, while lips 212 and 214 increase the strength of fuze body stem 204 in the crimp area. This provides a substantial advantage over the crimp grooves in the fuze design of the prior art, which tend to reduce strength in the crimp area, provide an inferior seal, and invite cracks from the crimping operation at assembly.

Detonator assembly 400 further comprises an explosive charge 430 positioned in detonator portion 412 below stem 204 of fuze body **200*a* to define an air gap 440**. The explosive charge is identical to that used in the current M213 hand grenade fuze.

An initiator lever assembly **500*a* is mounted to fuze body 200*a* and rotatable between an unprimed position and a primed position. Initiator lever assembly 500*a* comprises an initiator lever 502*a* elongated to define a handle to be restrained while holding and throwing the grenade G and having a longitudinal plane of symmetry, a distal end 504*a*, and a proximal end 506*a*. Initiator lever 502*a* is substantially planar adjacent proximal end 506*a* and curved adjacent distal initiator levers end 504*a*. Initiator lever 502*a* can be cast molded, or stamped as can 502*b* and 502*c*** described hereinafter.

A pair of opposed ears 510 extend from proximal end **506*a* of initiator lever 502*a* parallel to the plane of symmetry. Ears 510 include a pair of opposed circular apertures 512. Proximal end 506*a* of initiator lever 502*a* is positioned between side walls 220*a* of fuze body 200*a* with apertures 512 in ears 510 in registration with upper apertures 240*a* in side walls 220*a*. A pin 520 is inserted through apertures 512 and apertures 240*a*, allowing initiator lever 502*a* to rotate between a first position corresponding to the unprimed position of initiator lever assembly 500*a* and a second position corresponding to primed position of initiator lever assembly 500*a***.

A firing pin 530 is formed integrally with initiator lever **502*a*, firing pin 530 being positioned on initiator lever 502*a* to engage primer 320 when initiator lever 502*a* is in its second position and initiator lever assembly 502*a* is in its primed position. A coil spring 540 is mounted around pin 520, one end 542 of spring 540 extending outwardly and engaging initiator lever 502*a* and the other end 544 bearing against back wall 224*a* of fuze body head 204*a* to bias initiator lever 502*a* in its second position. Coil spring 540** is made from high tensile strength wire, such as rocket wire, available through the National Standard Company Niles, Michigan, to withstand long periods of shelf life without reducing the reliability of its functioning capability.

Primer 320 is protected by a cover assembly 600*a*, which also bears against and in part covers initiator lever assembly 500*a* in its unprimed position. Cover assembly 600*a* comprises a cover piece 602*a* having the same longitudinal plane of symmetry as initiator lever 502*a* and having a top portion 604*a* covering the top of fuze body head 202*a*, a bottom portion 606*a* covering the back edges of side walls 220*a*, a lower surface 608*a* facing fuze body head 202*a*, and an upper surface 610*a* opposite lower surface 608*a*. Top portion 604*a* includes at its front edge a hinge clasp 620*a* that extends over and engages hinge lugs 250*a*, so that cover assembly 600*a* can be rotated by the user upwardly and forward of hinge lugs 250*a* to permit initiator lever assembly 500*a* to be released from its unprimed position. Bottom portion 606*a* includes a pair of side extensions 630*a* extending substantially perpendicular to lower and upper surfaces 608*a* and 610*a*. Side extensions 630*a* include a pair of opposed circular apertures 632*a* in registration with the upper ends of elongated slots 244*a* in side walls 220*a*.

A rotatable safety latch 640 is mounted on bottom portion 606*a* of cover piece 602*a* for retaining initiator lever 502*a* in its unprimed position. Safety latch 640 comprises a pair of oppositely extending lugs 642 mounted below lower surface 608*a* of bottom portion 606*a* of cover piece 602*a* for engaging elongated slots 244*a*, and a dial 644 mounted above upper surface 610*a* of bottom portion 606*a*. Lugs 642 and dial 644 are operatively connected via a pin 646 extending through bottom portion 606*a* for rotation about the longitudinal axis of pin 646 between a locked position and an unlocked position.

Dial 644 is provided with detent means such as a ball 650 and a spring 652 positioned in an aperture 654 for locking safety latch 640 in place in one of three positions, as by engaging dimples 660*a* in cover piece 602*a*. The three positions are a central safety position, in which lugs 642 are locked in slots 244*a*, and two armed positions, one to the left and one to the right of the safety position, in which lugs 642 are free of slots 244*a*. The three positions can be denoted by marks such as the letters "S" for "safe" and "A" for "armed" embossed or otherwise permanently marked on the surface of cover piece 602*a*. The use of left and right armed positions enables safety latch 640 to be easily used by both left and right handed users.

Initiator lever 502*a* is further retained in its unprimed position by a pull ring assembly 700. Pull ring assembly 700 comprises an elongated cotter pin 702 or the like adapted to be inserted through the upper ends of lower elongated slots 244*a* in side walls 220*a* and circular apertures 632*a* in cover assembly 600*a* and a pull ring 704 for pulling cotter pin 702 out of slots 244*a* and apertures 632*a*. When cotter pin 702 is in place, it further blocks movement of lugs 642 of safety latch 640, thus acting as a lock against accidental movement of safety latch 640.

In operation, to prepare grenade G to be thrown, pull ring assembly 700 is removed from safety fuze 100*a* by pulling on pull ring 704. Once cotter pin 702 has been removed from apertures 632*a* and slots 244*a*, safety latch 640 is rotated to disengage lugs 642 from slots 244*a*. All elements holding cover piece 602*a* in place are now removed and grenade G is prepared to be thrown. If the user reverses his decision to throw the grenade, he can easily reassemble cover assembly 600 and make it safe again. Otherwise, cover piece 602*a* is removed.

Upon release from the user's hand, spring 540 urges initiator lever 502*a* of initiator lever assembly 500*a* into its primed position. When initiator lever 502*a* reaches its primed position, firing pin 530 strikes against primer 320, causing it to ignite primer booster charge 322 and ignition charge 334. Ignition charge 334 ignites delay charge 332, which burn will burn for a desired period of time depending in a known manner on its length and composition. Delay charge 332 in turn ignites penetration charge 330, which burns through the closed bottom 306 of delay case 300 and the closed bottom 268 of fuze body stem 204 to ignite explosive charge 430 in detonator assembly 400.

Referring now to FIGS. 1, 3, 6, and 10, there is shown a second embodiment of a grenade fuze 100*b* for a hand grenade G. Fuze 100*b* comprises a fuze body 200*b* of substantially conventional construction having a head 202*b*, a stem 204, and a central portion 206 intermediate head 202*b* and stem 204. Central portion 206 and stem 204 of fuze body 200*b* are identical to those of fuze body 200*a* of fuze 100*a*. A cylindrical bore 260 identical to cylindrical bore 260 of fuze 100*a* extends longitudinally through fuze body 200*b*. A delay case assembly 300 identical to delay case assembly 300 of fuze 100*a* is inserted in bore 260.

Head 202*b* is similar to head 202' of the M213 hand grenade fuze and has a pair of opposed side walls 220*b* of substantially right trapezoidal profile, a front wall 222*b*, a back wall 224*b* opposite front wall 222*b* and inset from the back edges of side walls 220*b*, a top wall 226*b* inset from the top edges of front wall 222*b* and side walls 220*b*, and a bottom wall 228*b* opposite top wall 226*b*. Side walls 220*b* include an upper pair of opposed circular apertures 240*b* adjacent their back, upper corners and a lower pair of opposed circular apertures 242*b* spaced downwardly from upper circular apertures 240*b*, both for a purpose to be described hereinafter. Front wall 222*b* includes a hinge pin 250*b* extending from the top thereof, also for a purpose to be described hereinafter. Bottom wall 228*b* includes a short transverse extension 232*b* extending downwardly from the back thereof, extension 232*b* having a groove 234*b* formed therein for a purpose also to be described hereinafter.

Striker lever assembly 500*b* is mounted to fuze body 200*b* and rotatable between an unprimed position and a primed position. Striker lever assembly 500*b* comprises an striker lever 502*b* elongated so that in its primed position, distal end 504*b* extends forwardly of front wall 222*b* of fuze body head 202*b*. As shown in FIG. 3, striker lever 502*b* extends to a point between the bottom of central portion 206 of fuze body 200*b* and the bottom of stem 204 of fuze body 200*b*. It is thus substantially longer than the striker 502' of the M213 fuze.

Striker lever 502*b* is substantially planar and has a longitudinal plane of symmetry, a distal end 504*b*, and a proximal end 506*b*. Proximal end 506*b* of striker lever 502*b* is positioned at the top of fuze body 200*b* between side walls 220*b* and is rotatable between a first position corresponding to the unprimed position of striker lever assembly 500*b* and a second position corresponding to the primed position of striker lever assembly 500*b*. A pair of opposed ears 510 extend from proximal end 506*b* of striker lever 502*b* parallel to the plane of symmetry. Ears 510 include a pair of opposed circular apertures 512. Striker lever 502*b* is mounted to fuze body 200*b* in the same manner as initiator lever 502*a* is mounted to fuze body 200*a*, by means of a pin 520 inserted through apertures 512 and apertures 540, and a coil spring 540 mounted around pin 520. A firing pin 530 is formed integrally or separately with striker lever 502b, firing pin 530 being positioned on striker lever 502b to engage primer 320 when striker lever 502b is in its second position and striker lever assembly 500b is in its primed position.

Figure 6A:
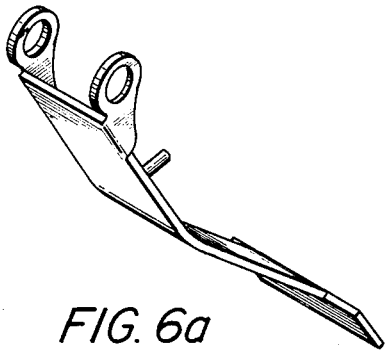
FIG. 6*a* is a perspective view of an alternate embodiment of the initiator lever assembly for the safety fuze of FIG. 1.
Figure 6:
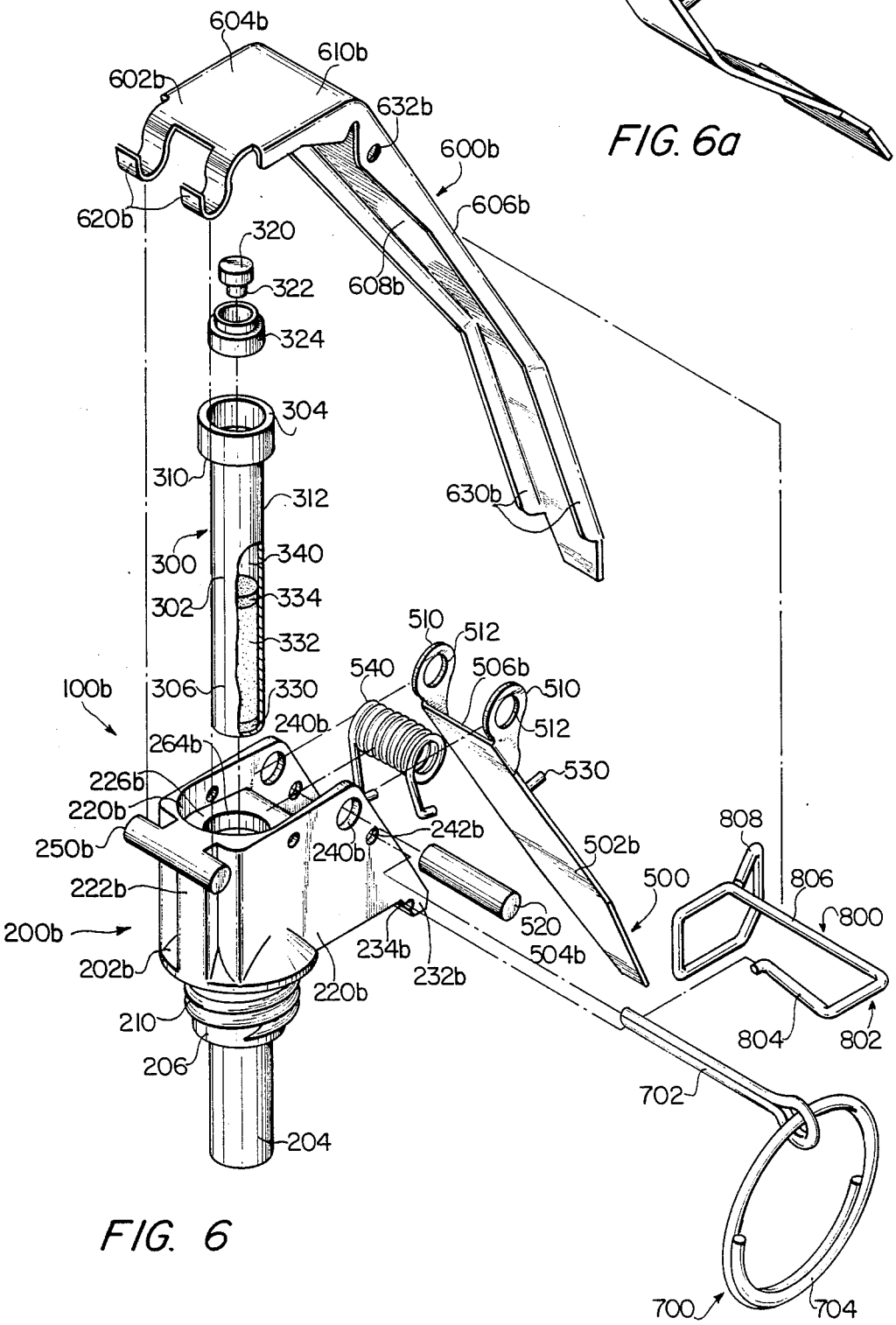
FIG. 6 is an exploded perspective view of the safety fuze of FIG. 1.
Figure 7:
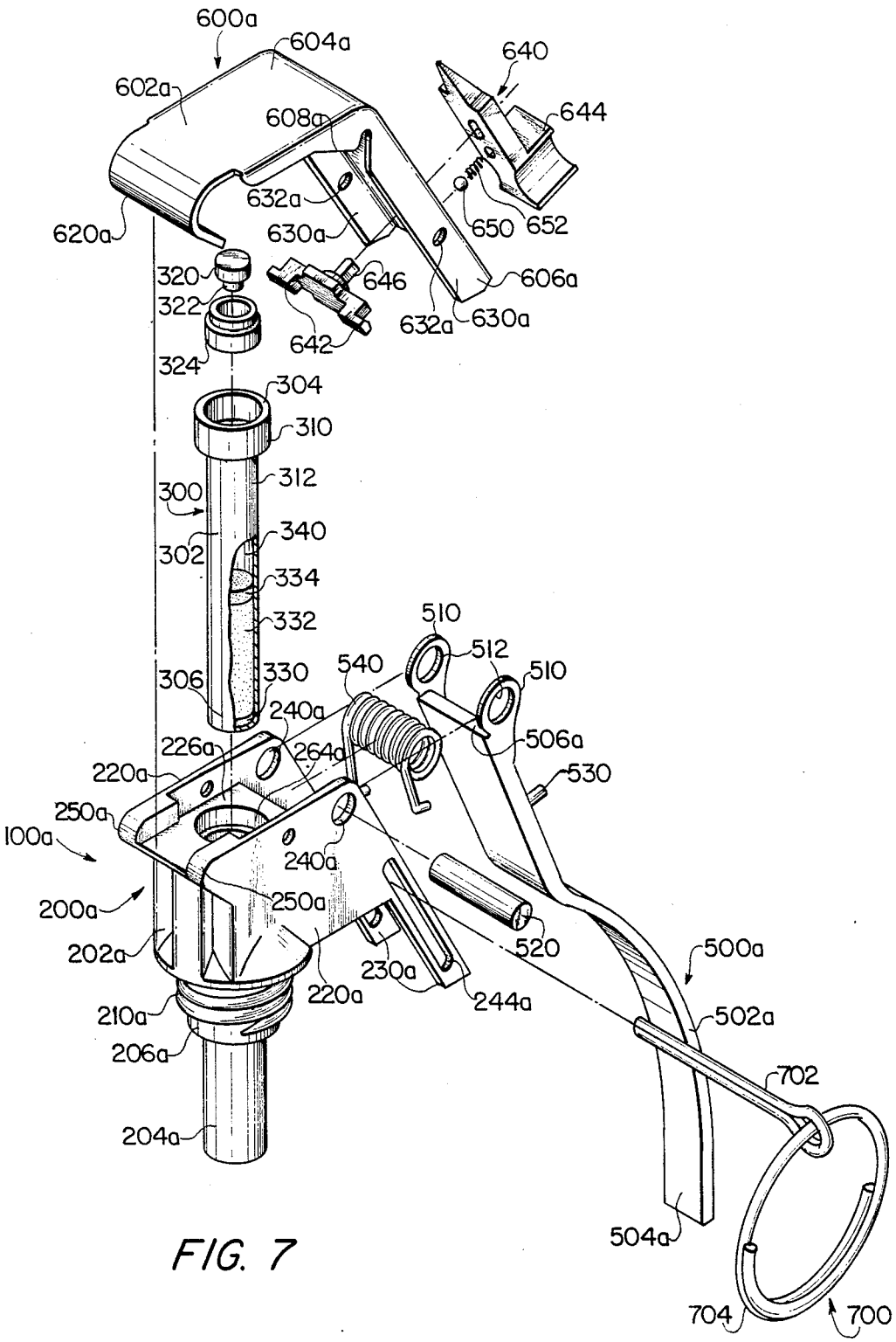
FIG. 7 is an exploded perspective view of the safety fuze of FIG. 2.

In an alternate embodiment, shown in FIG. 6a, striker lever assembly 500b' has a contoured, compressed S-shaped profile. A pair of opposed tabs 514b' extend integrally outwardly from the distal end 504b' to form a T with striker lever 502b'. Clenching bottom portion 606b of cover lever assembly 600b and tabs 514b' simultaneously provides a safety applicable to both left- and right-handed users that necessitates the deliberate release of both in order to initiate the firing sequence.

Primer 320 is protected by a cover lever assembly 600b, which also covers striker lever assembly 500b and acts as a handle to be restrained while holding and throwing grenade G. Cover lever assembly 600b is substantially identical to a conventional cover assembly 600' for an M213 grenade fuze and comprises a cover piece 602b having the same longitudinal plane of symmetry as striker lever 502b and having a top portion 604b covering the top of fuze body head 202b, a bottom portion 606b covering the back edges of side walls 220b and extension 232b and extending below the bottom of detonator assembly 400, a lower surface 608b facing fuze body head 202b and extension 232b, and an upper surface 610b opposite lower surface 608b. Top portion 604b includes at its front edge a pair of parallel, spaced-apart hooks 620b for engaging hinge pin 250b, so that cover lever assembly 600b can rotate upwardly around hinge pin 250b when striker lever assembly 500b and cover lever assembly 600b are released from its unprimed position. Bottom portion 606b includes a pair of side extensions 630b which are approximately parallel to the plane of symmetry and include a pair of opposed circular apertures 632b in registration with lower circular apertures 242b in side walls 220b of fuze body 200b.

Striker lever 502b is retained in its unprimed position by a pull ring assembly 700 identical to pull ring assembly 700 of safety fuze 100a. Cotter pin 702 is inserted through circular apertures 632b in side extensions 630b and lower circular apertures 242b in side walls 220b.

Striker lever 502b is further retained in its unprimed position by a conventional safety clip 800. Clip 800 includes a resilient, J-shaped hook portion 802, the short arm 804 of which engages groove 234b and the long arm 806 of which bears against cover lever assembly 600b to hold cover lever assembly 600b against the back edges of side walls 220b. Clip 800 also includes a handle portion 808 attached to the long arm 806 of hook portion 802, by which clip 800 can be grasped and removed.

In operation, to prepare grenade G to be thrown, pull ring assembly 700 is removed from grenade fuze 100b by pulling on pull ring 704 to remove cotter pin 702, and safety clip 800 is removed from grenade fuze 100b by pulling on handle portion 808 to disengage hook portion 802 from groove 234b. Spring 540 is then free to urge striker lever 502b into its primed position.

Figure 9:
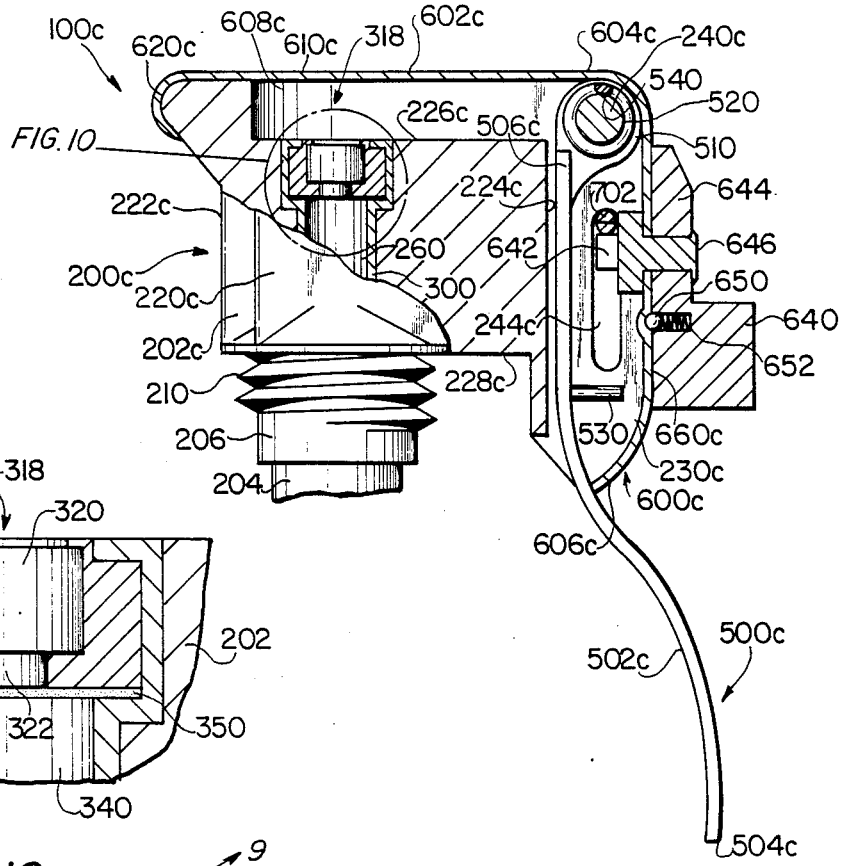
FIG. 9 is a cross-sectional view of the safety fuze of FIG. 8, taken along line 9—9 of FIG. 8.
Figure 10:
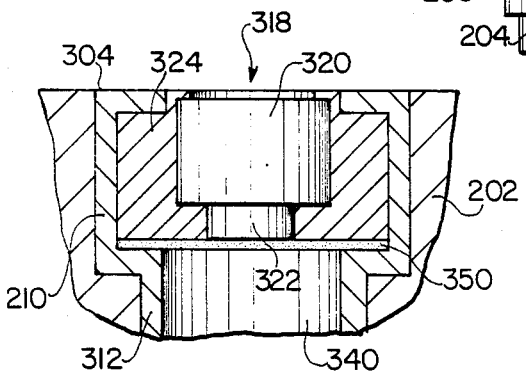
FIG. 10 is an enlarged cross-sectional view of the primer assembly of the safety fuze of FIGS. 3, 4, and 9.
Figure 8:
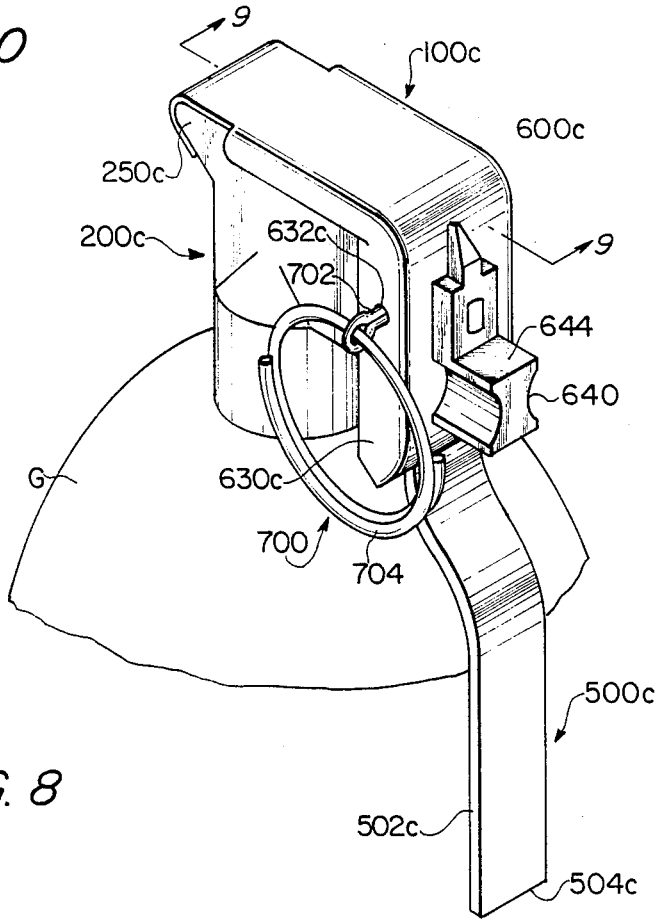
FIG. 8 is a perspective view of a third embodiment of the safety fuze of the invention.
Figure 11:
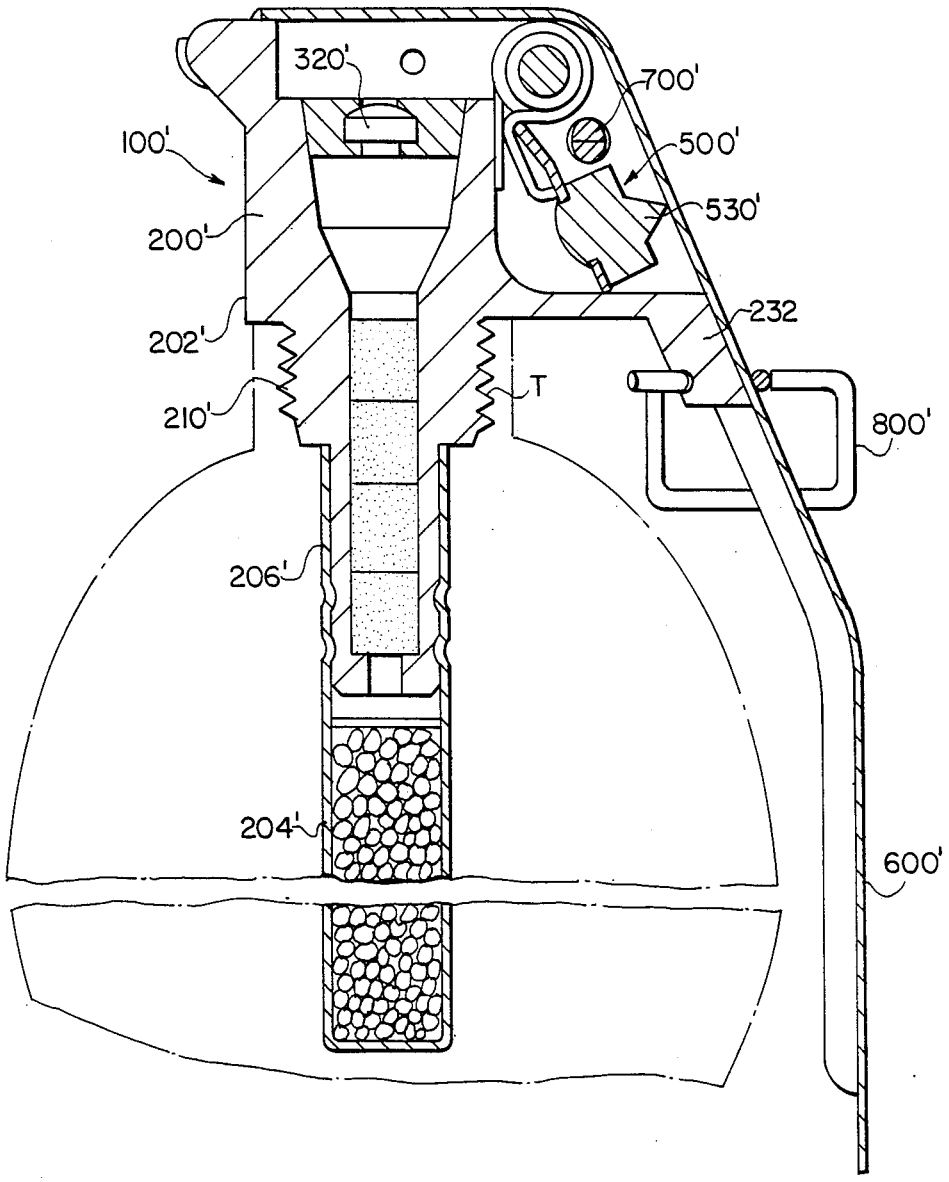
FIG. 11 PRIOR ART
FIG. 11 is a cross-sectional view of the prior art M213 fuse for a hand grenade.

Referring now to FIGS. 8–10, there is shown a third embodiment of a safety fuze 100c for a hand grenade G. Fuze 100c comprises a fuze body 200c having a head 202c, a stem 204, and a central portion 206. Central portion 206 and stem 204 of fuze body 200c are identical to those of fuze bodies 200a and 200b of fuzes 100a and 100b. A cylindrical bore 260 identical to cylindrical bore 260 of fuzes 100a and 100b extends longitudinally through fuze body 200c. A delay case assembly 300 identical to delay case assembly 300 of fuzes 100a and 100b is inserted in bore 260.

Head 202c has a pair of opposed side walls 220c of substantially rectangular profile, a front wall 222c, a back wall 224c opposite front wall 222c and inset from the back edges of side walls 220b, a top wall 226c inset from the top edges of front wall 222c and side walls 220c, and a bottom wall 228c opposite top wall 226c. Side walls 220c include a pair of opposed, parallel extensions 230c extending downwardly from bottom wall 228c. Side walls 220c also include an upper pair of opposed circular apertures 240c adjacent their back, upper corners, and a lower pair of opposed elongated slots 244c spaced downwardly from upper circular apertures 240c and extending into the extensions 230c, all for a purpose to be described hereinafter. Front wall 222c includes a pair of hinge lugs 250c extending from the top thereof, identical to hinge lugs 250a of fuze 100a.

Squaring of head 202c of fuze body 200c gives fuze body 200c a longer fulcrum arm than fuze body 200b with its angled head 202a.

An initiator lever assembly 500c is mounted to fuze body 200c and rotatable between an unprimed position and a primed position. Initiator lever assembly 500c comprises an initiator lever 502c elongated to define a handle to be restrained while holding and throwing the grenade G and having a longitudinal plane of symmetry, a distal end 504c, and a proximal end 506c. Initiator lever 502c is substantially planar adjacent proximal end 506c and curved adjacent distal end 504c.

A pair of opposed ears 510 extend from proximal end 506 of initiator lever 502 parallel to the plane of symmetry. Ears 510 include a pair of opposed circular apertures 512. Proximal end 506c of initiator lever 502c is positioned between side walls 220c of fuze body 200c with apertures 512 in ears 510 in registration with upper apertures 240c in side walls 220c. A pin 520 is inserted through apertures 512 and apertures 240c, allowing initiator lever 502c to rotate between a first position corresponding to the unprimed position of initiator lever assembly 500c and a second position corresponding to primed position of initiator lever assembly 500c.

A firing pin 530 is formed integrally with initiator lever 502c, firing pin 530 being positioned on initiator lever 502c to engage primer 320 when initiator lever 502c is in its second position and initiator lever assembly 502c is in its primed position. A coil spring 540 is mounted around pin 520, one end 542 of spring 540 extending outwardly and engaging initiator lever 502c and the other end 544 bearing against back wall 224c of fuze body head 204c to bias initiator lever 502c in its second position.

Primer 320 is protected by a cover assembly 600c, which also bears against and in part covers initiator lever assembly 500c in its unprimed position. Cover assembly 600c comprises a cover piece 602c having the same longitudinal plane of symmetry as initiator lever 502c and having a top portion 604c covering the top of fuze body head 202c, a bottom portion 606c covering the back edges of side walls 220c, a lower surface 608c facing fuze body head 202c, and an upper surface 610c opposite lower surface 608c. Top portion 604c includes at its front edge a hinge clasp 620c for engaging hinge lugs 250c over its top, so that cover assembly 600c can rotate upwardly around hinge lugs 250c when initiator lever assembly 500c is released from its unprimed position. Clasps 620c wrap around the top of hinge lugs 250c to provide a faster release for cover assembly 600c than is possible where the hooks wrap around the bottom, as in fuze 100b.

Bottom portion 606c includes a pair of side extensions 630c (FIG. 8) extending substantially perpendicular to lower and upper surfaces 608c and 610c. Side extensions 630c include a pair of opposed circular apertures 632c in registration with the upper ends of elongated slots 244c in side walls 220c.

A rotatable safety latch 640 identical to safety latch 640 of fuze 100a is mounted on bottom portion 606c of cover piece 602c for retaining initiator lever 502c in its unprimed position. Lugs 642 are mounted below lower surface 608c of bottom portion 606c of cover piece 602c for engaging slots 244c, and a dial 644 is mounted above upper surface 610c of bottom portion 606c. Dimples 660c in cover piece 602c are engaged by ball 650 of safety latch 640 (FIG. 9).

Initiator lever 502c is further retained in its unprimed position by a pull ring assembly 700 identical to pull ring assembly 700 of fuze 100a. Cotter pin 702 of pull ring assembly 700 is inserted through the upper ends of lower elongated slots 244c in side walls 220c and circular apertures 632c in cover assembly 600c.

In operation, to prepare grenade G to be thrown, pull ring assembly 700 is removed from safety fuze 100c by pulling on pull ring 704. Once cotter pin 702 has been removed from apertures 632c and slots 244c, safety latch 640 is rotated to disengage lugs 642 from slots 244c and cover assembly 600c is removed. Spring 540 is then free to urge initiator lever 502c into its primed position.

From the above, it is apparent that many modifications and variations of the present invention are possible in light of the above teachings. It is therefore to be understood that, within the scope of the appended claims, the invention may be practiced otherwise than as specifically described.

We claim:

1. A fuze for a hand grenade comprising:

(a) a fuze body having a top having a recess therein, a closed bottom, a head adjacent said fuze body top, a stem adjacent said fuze body bottom, and a central portion intermediate said fuze body head and stem, and a bore extending longitudinally through said fuze body, said recess having an opening therein, said opening in said recess defining the top of said bore and said closed of said fuze body defining the bottom of said bore, said head having a pair of opposed front and back walls, a pair of opposed side walls having back edges, and said fuze body central portion including engaging means for engaging the grenade;

(b) a primer positioned in said top of said bore and a delay charge positioned adjacent the bottom of said bore, (c) detonator assembly means for detonating the hand grenade, said detonator assembly means including a detonator case sealingly engaging the exterior of said fuze body stem and an explosive detonator charge positioned in said detonator case;

(d) an initiator lever assembly mounted on said fuze body and rotatable between an unprimed position and a primed position, comprising:

an initiator lever having a longitudinal plane of symmetry, a distal end and a proximal end and top and bottom surfaces, said initiator lever being rotatable about said proximal end thereof between a first position corresponding to said unprimed position and a second position corresponding to said primed position, said initiator lever being elongated to prevent said initiator lever from being unknowningly released;

mounting means for mounting said proximal end of said initiator lever to said fuze body head adjacent said fuze body top for rotation about an axis perpendicular to said plane of symmetry of said initiator lever between said first position and said second position;

biasing means for biasing said initiator lever in said second position; and a firing pin mounted on said initiator lever, said firing pin being positioned on said initiator lever to engage said primary when said initiator lever assembly is in said primed position;

(e) a cover assembly comprising a cover piece having a top portion covering said fuze body top and a bottom portion covering said back edges of said side walls, said cover assembly having pin-receiving apertures therein; and (f) a pull ring assembly having elongated retaining pin means for retaining said initiator lever in said first position thereof when said retaining pin is inserted in said pin-receiving apertures.

2. The fuze of claim 1, said distal end of said initiator lever extending forwardly of said front wall of said fuze body head the primed position o said initiator lever.

3. The fuze of claim 1, said cover piece being elongated to define a handle to be restrained while holding and throwing the grenade.

4. The fuze of claim 1, said fuze body having a bottom wall having a back edge, said bottom wall including a short transverse extension extending downwardly from said back edge thereof, said extension having a groove formed therein, and said fuze further comprising a safety clip including hook means for engaging said groove in said extension.

5. The fuze of claim 1, said firing pin being formed integrally with said initiator lever.

6. The fuze of claim said side walls having a substantially rectangular profile.

7. The fuze of claim 1, said fuze body stem having a pair of raised annular lips formed therein adjacent said fuze body central portion and said detonator case being crimped around said lips to form raised crimps to form a positive sealing engagement between said detonator case and said fuze body stem.

8. A fuze for a hand grenade comprising:

(a) a fuze body having a top having a recess therein, a closed bottom, a head adjacent said fuze body top, a stem adjacent said fuze body bottom, and a central portion intermediate said fuze body head and stem, and a bore extending longitudinally through said fuze body, said recess having an opening therein, said opening in said recess defining the top of said bore and said fuze body bottom defining the bottom of said bore, said head having a pair of opposed front and back walls, a pair of opposed side walls having back edges, and said fuze body central portion including engaging means for engaging the grenade;

(b) a primer positioned in said top of said bore;

(c) detonator assembly means for detonating the hand grenade, said detonator assembly means including a detonator case sealingly engaging the exterior of said fuze body stem and an explosive detonator charge positioned in said detonator case;

(d) an initiator lever assembly mounted on said fuze body and rotatable between an unprimed position and a primed position, comprising:

an initiator lever having a longitudinal plane of symmetry, a distal end and a proximal end and top and bottom surfaces, said initiator lever being rotatable about said proximal end thereof between a first position corresponding to said unprimed position and a second position corresponding to said primed position, said initiator lever being elongated to define a handle to be restrained while holding and throwing the grenade;

mounting means for mounting said proximal end of said initiator lever to said fuze head adjacent said fuze body top for rotation about an axis perpendicular to said plane of symmetry of said initiator lever between said first position and said second position;

biasing means for biasing said initiator lever in said second position; and a firing pin mounted on said initiator lever, said firing pin being positioned on said initiator lever to engage said primer when said initiator lever assembly is in said primed position;

(e) a cover assembly comprising a cover piece having a top portion covering said fuze body top and a bottom portion covering said back edges of said side walls, said cover assembly having pin-receiving apertures therein; and (f) a pull ring assembly having elongated retaining pin means for retaining said initiator lever in said first position thereof when said retaining pin is inserted in said pin-receiving apertures.

9. The fuze of claim 8, said side walls of said fuze body head including a pair of opposed, parallel extensions, said extensions having a pair of opposed, elongated slots therein, and said cover piece bottom portion also covering said extensions and including a pair of opposed pin-receiving apertures in registration with a portion of said elongated slots in said extensions, and said cover assembly further comprising safety latch means mounted on said bottom portion of said cover piece movable between a first position for retaining said initiator lever in said first position by engaging a portion of said elongated apertures in said extensions and a second position for permitting movement of said initiator lever into said second position.

10. The fuze of claim 3, said front wall including a pair of hinge lugs extending therefrom at said fuze body top and said cover assembly including a hinge clasp extending over and engaging said hinge lugs, whereby said cover assembly can be rotated by a user of the grenade upwardly and forward of said hinge lugs

11. The fuze of claim 8, said firing pin being formed integrally with said initiator lever.

12. The fuze of claim 8, said side walls having a substantially rectangular profile.

13. The fuze of claim 8, said fuze body stem having a pair of raised annular lips formed therein adjacent said fuze body central portion and said detonator case being crimped around said lips to form a positive sealing engagement between said detonator case and said fuze body stem.

14. A fuze for a hand grenade comprising:

(a) a fuze body having a top having a recess therein, a closed bottom, a head adjacent said fuze body top, a stem adjacent said fuze body bottom, and a central portion intermediate said fuze body head and stem, and a bore extending longitudinally therethrough, said recess having an opening therein, said opening in said recess defining the top of said bore and said fuze body bottom defining the bottom of said bore;

(b) a delay case assembly comprising:

a delay case matingly received in said bore and having an open top and a closed bottom, a primer portion adjacent said top and a delay portion adjacent said bottom;

a moisture-proof seal separating said primer portion from said delay portion;

a primer assembly positioned in said primer portion;

a penetration charge positioned at said bottom of said delay case;

a delay charge positioned above said penetration charge; an ignition charge positioned above said delay charge; and an air gap separating said seal from said ignition charge; and (c) a detonator assembly comprising:

a detonator case having an open top and a closed bottom, a receiving portion adjacent said detonator case top, a detonator portion adjacent said detonator case bottom, and a detonator case central portion intermediate said detonator case top and bottom, said receiving portion matingly receiving said fuze body stem and said detonator case top being in positive sealing engagement with said fuze body; and an explosive detonator charge positioned in said detonator case bottom portion, said detonator case central portion providing a gap between said fuze body and said explosive charge.

15. The fuze of claim 14, said primary assembly comprising a primer holder having a top and a bottom, a primary positioned in said primer holder top, and a primer booster charge positioned beneath said primer in said primer holder bottom.

16. A fuze for a hand grenade comprising:

(a) a fuze body having a top having a recess therein, a closed bottom, a head adjacent said fuze body top, a stem adjacent said fuze body bottom, and a central portion intermediate said fuze body head and stem, and a bore extending longitudinally through said fuze body, said recess having an opening therein, said opening in said recess defining the top of said bore and said closed bottom of said fuze body defining the bottom of said bore, said head having a pair of opposed front and back walls, a pair of opposed side walls, and said fuze body central portion including engaging means for engaging the grenade;

(b) detonator assembly means in sealing engagement with the exterior of said stem for detonating the hand grade, said detonator assembly means including an explosive detonator charge;

(c) delay case assembly means positioned in said bore for perforating said closed bottom of said fuze body and igniting said detonator charge, said delay case assembly means having an open top, a closed bottom, a delay charge adjacent said bottom and a primer at said top, and being substantially coextensive with said bore;

(d) an initiator lever assembly mounted on said fuze body and rotatable between an unprimed position and a primed position, comprising:

an initiator lever having a longitudinal plane of symmetry, a distal end and a proximal end and top and bottom surfaces, said initiator lever being rotatably mounted on said fuze head about an axis perpendicular to said plane of symmetry between a first position corresponding to said unprimed position and a second position corresponding to said primed position, said initiator lever being elongated to prevent sad initiator lever from being unknowingly released;

biasing means for biasing said initiator lever in said second position; and a firing pin mounted on said initiator lever, said firing pin being positioned on said initiator lever to engage said primer when said initiator lever assembly is in said primed position;

(e) cover assembly means for protecting said primer and bearing against said initiator lever assembly; and (f) retaining means for retaining said initiator lever in said first position thereof.

17. The fuze of claim 16, said distal end of said initiator lever extending forwardly of said front wall of said fuze body head in the primed position o said initiator lever.

18. The fuze of claim 16, said cover assembly comprising a cover piece elongated to define a handle to be restrained while holding and throwing the grenade.

19. The fuze of claim 18 said fuze body bottom wall having a back edge, said bottom wall including a short transverse extension extending downwardly from said back thereof, said extension having a groove formed therein, and said fuze further comprising a safety clip including hook means for engaging said groove in said extension.

20. The fuze of claim 16, said firing pin being formed integrally with said initiator lever.

21. The fuze of claim 16, said fuze body stem having a pair of raised annular lips formed therein adjacent said fuze body central portion and said detonator case being crimped around said lips to form a positive sealing engagement between said detonator case and said fuze body stem.

22. The fuze of claim 6, said fuze body having a bottom wall having a back edge, said bottom wall including a short transverse extension extending downwardly from said back edge thereof, said extension having a groove formed therein, and said fuze further comprising a safety clip including hook means for engaging said groove in said extension.

23. A fuze for a hand grenade comprising:

(a) a fuze body having a top having a recess therein, a closed bottom, a head adjacent said fuze body top, a stem adjacent said fuze body bottom, and a central portion intermediate said fuze body head and stem, and a bore extending longitudinally through said fuze body, said recess having an opening therein, said opening in said recess defining the top of said bore and said fuze body bottom defining the bottom of said bore, said head having a pair of opposed front and back walls, a pair of opposed side walls, and said fuze body central portion including engaging means for engaging the grenade;

(b) detonator assembly means in sealing engagement with the exterior of said stem for detonating the hand grenade, said detonator assembly means including an explosive detonator charge;

(c) delay case assembly means positioned in said bore for perforating said closed bottom of said fuze body and igniting said detonator charge, said delay case assembly means having a primer at the top thereof and being substantially coextensive with said bore;

(d) an initiator lever assembly mounted on said fuze body and rotatable between an unprimed position and a primed position, comprising:

an initiator lever having a longitudinal plane of symmetry, a distal end and a proximal end and top and bottom surfaces, said initiator lever being rotatably mounted on said fuze head about an axis perpendicular to said plane of symmetry between a first position corresponding to said unprimed position and a second position corresponding to said primed position, said initiator lever being elongated to define a handle to be restrained while holding and throwing the grenade;

biasing means for biasing said initiator lever in said second position; and a firing pin mounted on said initiator lever, said firing pin being positioned on said initiator lever to engage said primer when said initiator lever assembly is in said primed position;

(e) cover assembly means for protecting said delay case assembly means top and bearing against said initiator lever assembly; and (f) retaining means for retaining said initiator lever in said first position thereof.

24. The fuze of claim 23, said side walls of said fuze body head including a pair of opposed, parallel extensions, said extensions having a pair of opposed, elongated slots therein, and said cover piece bottom portion also covering said extensions and including a pair of opposed pin-receiving apertures in registration with a portion of said elongated slots in said extensions, and said cover assembly further comprising safety latch means mounted on said bottom portion of said cover piece movable between a first position for retaining said initiator lever in said first position by engaging a portion of said elongated apertures in said extensions and a second position for permitting movement of said initiator lever into said second position.

25. The fuze of claim 23, said front wall including a pair of hinge lugs extending therefrom at said fuze body top and said cover assembly including a hinge clasp extending over and engaging said hinge lugs, whereby said cover assembly can be rotated by a user of the grenade upwardly and forward of said hinge lugs.

26. The fuze of claim 23, said firing pin being formed integrally with said initiator lever.

27. A fuze for a hand grenade comprising:

(a) a fuze body having a head, a stem, and a central portion intermediate said head and said stem, and a bore extending longitudinally through said head, said central portion, and stem, said central portion including engaging means for engaging the grenade;

(b) a primer positioned in the top of said bore;

(c) detonator assembly means in sealing engagement with the exterior of said stem for detonating the hand grenade;

(d) an initiator lever assembly mounted on said fuze body and rotatable between an unprimed position and a primed position, comprising:

an initiator lever having a longitudinal plane of symmetry, a distal end, and a proximal end, said initiator lever being rotatable about said proximal end thereof between a first position corresponding to said unprimed position and a second position corresponding to said primed position, said initiator lever being elongated to define a handle to be restrained while holding and throwing the grenade;

mounting means for mounting said proximal end of said initiator lever to said fuze body head for rotation about an axis perpendicular to said plane of symmetry of said initiator lever between said first position and said second position;

biasing means for biasing said initiator lever in said second position; and a firing pin mounted on said initiator lever, said firing pin being positioned on said initiator lever to engage said primer when sad initiator lever assembly is in said primed position;

(e) cover assembly means for protecting said primer and bearing against said initiator lever assembly; and (f) retaining means for retaining said initiator lever in said first position thereof.

28. The fuze of claim 27, said fuze body head having a pair of opposed side walls, said side walls including a pair of opposed, parallel extensions, said extensions having a pair of opposed, elongated slots therein, and said cover assembly means also covering said extensions and including a pair of opposed pin-receiving apertures in registration with a portion of said elongated lots in said extensions, and said cover assembly means including safety latch means movable between a first position for retaining said initiator lever in said first position by engaging a portion of said elongated apertures in said extensions and a second position for permitting movement of said initiator lever into said second position.

29. The fuze of claim 27, said firing pin being formed integrally with said initiator lever.

30. The fuze of claim 27, said fuze body head including a pair of hinge lugs extending from the top and front of said fuze body head and said cover assembly means including a hinge clasp extending over and engaging said hinge lugs, whereby said cover assembly means can be rotated by a user of the grenade upwardly and forward of said hinge lugs.

31. The fuze of claim 27, said fuze body stem having a pair of raised annular lips formed therein adjacent said fuze body central portion and said detonator assembly means including a detonator case, said detonator case being crimped around said lips to form a positive sealing engagement between said detonator case and said fuze body stem.

32. The fuze of claim 27, further comprising a delay case assembly comprising:

a delay case matingly received in said bore and having an open top and a closed bottom, a primer portion adjacent said top and a delay portion adjacent said bottom;

a moisture-proof seal separating said primer portion from said delay portion;

a primer assembly positioned in said primer portion, said primer assembly including said primer;

a penetration charge positioned at said bottom of said delay case;

a delay charge positioned above said penetration charge;

an ignition charge positioned above said delay charge; and an air gap separating said seal from said ignition charge.

33. The fuze of claim 32, said detonator assembly means comprising:

a detonator case having an open top and a closed bottom, a receiving portion adjacent said detonator case top, and a detonator portion adjacent said detonator case bottom, said receiving portion matingly receiving said fuze body stem and said detonator case top being in sealing engagement with said fuze body stem, and an explosive detonator charge positioned in said detonator case bottom portion, said detonator case central portion providing a gap between said fuze body bottom and said explosive charge.

34. The fuze of claim 32, said primer assembly further comprising a primer holding having a top and a bottom, and a primer charge, said primer being positioned in said primer holder top and said primer charge being positioned beneath said primer in said primer holder bottom.

* * * * *